US008847717B2

(12) United States Patent
Cook

(10) Patent No.: US 8,847,717 B2
(45) Date of Patent: Sep. 30, 2014

(54) MECHANISM FOR CAUSING PROPULSION OF A MAGNET

(71) Applicant: Jeffrey N. Cook, Maumee, OH (US)

(72) Inventor: Jeffrey N. Cook, Maumee, OH (US)

( * ) Notice: Subject to any disclaimer, the term of this patent is extended or adjusted under 35 U.S.C. 154(b) by 66 days.

(21) Appl. No.: 13/771,863

(22) Filed: Feb. 20, 2013

(65) Prior Publication Data

US 2013/0222095 A1 Aug. 29, 2013

Related U.S. Application Data

(60) Provisional application No. 61/634,042, filed on Feb. 23, 2012.

(51) Int. Cl.
*H01F 7/02* (2006.01)

(52) U.S. Cl.
CPC ..... *H01F 7/0242* (2013.01)
USPC ..... 335/306; 335/302

(58) Field of Classification Search
USPC ..... 335/302, 306; 310/12.01
See application file for complete search history.

(56) References Cited

U.S. PATENT DOCUMENTS

| | | | | |
|---|---|---|---|---|
| 4,074,153 | A * | 2/1978 | Baker et al. | 310/12.07 |
| 4,215,330 | A * | 7/1980 | Hartman | 335/306 |
| 4,877,983 | A * | 10/1989 | Johnson | 310/12.24 |
| 5,402,021 | A * | 3/1995 | Johnson | 310/12.24 |
| 7,015,782 | B2 * | 3/2006 | Kincaid et al. | 335/306 |
| 7,610,861 | B1 * | 11/2009 | Colclasure | 104/292 |
| 2010/0194210 | A1 * | 8/2010 | Homma et al. | 310/12.01 |

* cited by examiner

*Primary Examiner* — Bernard Rojas
(74) *Attorney, Agent, or Firm* — Dennis L. Cook, Esq.

(57) ABSTRACT

A propulsion mechanism that relies on magnets and the geometric property of a hole in a magnet in the direction of the polarity that always involves the addition of a directional component in the magnetic field. This additional direction component is benign in terms of pure geometry and non-ferrous materials without an interacting field of force, but when such a hole involves two or more magnets, the magnet not fixed experiences a net thrust away from the other.

1 Claim, 4 Drawing Sheets

MECHANISM FOR CAUSING PROPULSION OF A MAGNET

CROSS REFERENCE TO RELATED APPLICATION

The present application claims the benefit of previously filed co-pending Provisional Patent Application, U.S. Ser. No. 61/634,042 filed Feb. 23, 2012.

FIELD OF THE INVENTION

This invention belongs to the field of magnetic devices. More specifically it is a novel way of propelling a magnet using another magnet.

BACKGROUND OF THE INVENTION

A mechanism is disclosed that can be applied to the toy and hobby, robotic, machinery, automotive or other varied industries that causes propulsion over a limited distance without hydraulic or solenoidal thrust of equivalent magnitude that can be more efficient than the latter in many cases (especially air vacuum motive systems), depending on the system and the use of the mechanism. Magnets have been used in various configurations for propulsion purposes as shown in U.S. Pat. No. 4,074,153 to Baker, which uses a gradient thickness in the magnet to create propulsion forces. This mechanism, and all other similar prior art devices known to Applicant, does not use the unique configuration disclosed and claimed in this application.

The mechanism of this disclosure relies on magnets and the geometric property of a hole in a magnet in the direction of the polarity, as will be described, which always involves the addition of a directional component in the magnetic field. This additional directional component is benign in terms of pure geometry and non-ferrous materials without an interacting field of force, but when such a hole involves two or more magnets, the magnet not fixed experiences a net thrust away from the fixed magnet. This propulsion diminishes in a typical manner with distance due to inertia and Newton's Laws of Motion and cannot be made into a self-sustaining system by propelling it into another similar system, as the directional component is polarized and the propelled magnet meets with opposite poles on the opposite side of the next apparatus, which restricts its motion in the absence of additional energy input.

BRIEF SUMMARY OF THE INVENTION

The disclosed mechanism relies on magnets and the geometric property of a hole in a magnet in the direction of the polarity, as will be described, which always involves the addition of a directional component in the magnetic field. This additional directional component is benign in terms of pure geometry and non-ferrous materials without an interacting field of force, but when such a hole involves two or more magnets, the magnet not fixed experiences a net thrust away from the fixed magnet.

BRIEF DESCRIPTION OF THE DRAWINGS

For a fuller understanding of the nature and objects of the invention, reference should be made to the following detailed description, taken in connection with the accompanying drawings, in which.

DESCRIPTION OF THE PREFERRED EMBODIMENT

Figure 1:
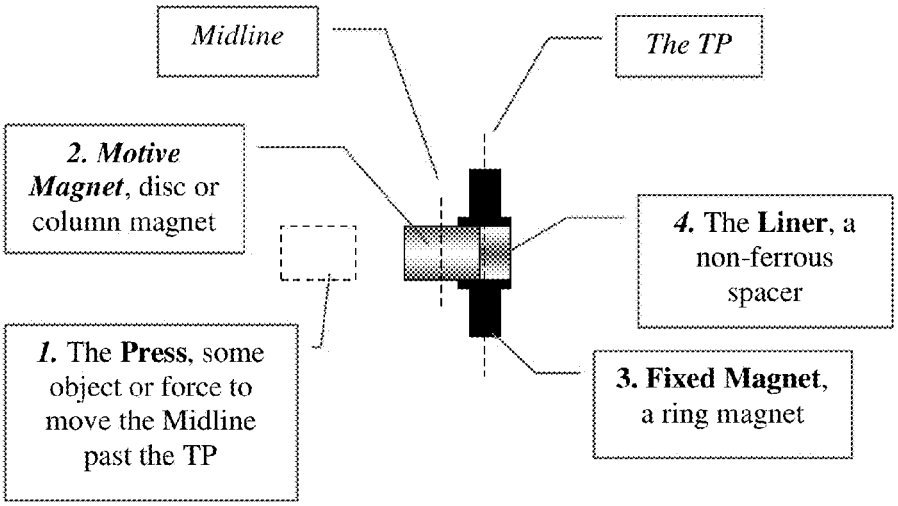
FIG. 1 shows one example of the four components with round magnets.

The mechanism consists of two or more magnets (permanent magnets or electric coils of varying configurations), where one magnet's outer diameter (OD) is less than the inner diameter (ID) of the other magnet (and is restricted from physically touching or coming too close to the other) when the poles across the flat faces of the two magnets are opposite, the magnet with the smaller diameter will experience propulsion away from the magnet with the larger OD when not fixed and forced beyond a certain point of its ID (typically the half-way point of its length in the absence of addition ferromagnetic materials).

The reverse scenario is also part of the mechanism, where a magnet with the smaller OD may be fixed instead, while the magnet with the larger OD is free to move; however, for sake of simplicity with regards to this patent application, the former will be described as the preferred embodiment so long as the mechanism is understood to be reversible in all cases between the two magnets.

The force required to press the magnet (the Press (1)) with the smaller OD (the Motive Magnet (2)) through the ID of the other (the Fixed Magnet (3)) has to do with the strength of the magnetic fields and the size of the Motive Magnet (2) with respect to the Fixed Magnet (3); a greater Fixed Magnet (3) ID to the Motive Magnet (2)'s OD requires less force to press it past this "threshold point" (TP) and vice versa, but any reduction of pressing force is proportional to the force of the Motive Magnet (2)'s propulsion.

The hole of the Fixed Magnet (3) need not be round, but can be square, triangular or any other shape, so long as the distance between the Motive Magnet (2) and the Fixed magnet is reasonably equally distributed throughout the propulsion process (i.e., a round magnet for a round hole works, as does a square magnet for a square hole, etc.).

The force required to press the Motive Magnet (2) through the hole of the Fixed Magnet (3) is typically small in respect to the usefulness of the work of the Motive Magnet (2), so long as size and weight factors are considered; so the force to bring the Motive Magnet (2) beyond the TP can be done by hand in some cases, with an electromagnet solenoid in others, by turning of a crank or lever or other means conceivable by those skilled in the art.

Provided some structural barrier or object (the Liner (4)) prevents the Motive Magnet (2) from touching the Fixed Magnet (3) upon passing (a non-ferrous tube placed in the Fixed Magnet (3)'s ID for instance), the Motive Magnet (2) will move smoothly through the ID of the Fixed Magnet (3).

This smoothness of motion reduces the amount of force required to press the Motive Magnet (2) beyond the TP, and can be increased with lubrication (grease, etc.), and/or applying additional structural components to the magnet (bearings, wheels, etc.) or other conceivable methods known by those skilled in the art.

When pressed beyond the TP, the Motive Magnet (2) not only accelerates out of the Fixed Magnet (3)' s ID in the same direction, coming to rest eventually due to inertia and Newton's Laws of Motion, but also decelerates proportionately to the magnitude of the Press (1) force.

The velocity at which the Motive Magnet (2) is pressed beyond the TP is independent of the propulsion velocity and/or acceleration, as it can be pressed at regular or irregular increments of time, even quite slowly if required; the acceleration of the Motive Magnet (2) once brought beyond the TP is caused by other factors than the press velocity, but their respective forces are proportionate.

When bringing the Motive Magnet (2) near the Fixed Magnet (3)' s ID with similar-facing poles, the Motive Magnet (2)' s tendency to flip around so that opposite poles are facing is considerably greater than the two magnet's tendency to be repelled, so long as it is prevented from moving side to side; thus, a locking mechanism is also part of the invention on the opposite side of the apparatus from the propulsion.

Some amount of side to side motion limitation is required near both faces of the Fixed Magnet (3) to allow for both the locking and propulsion mechanisms, but this requirement drops off with distance; thus, a non-ferrous tube entering and exiting the larger magnet's hole is effective for use as the Liner (4).

The simplest design of this invention consists of just four components, but this invention need not be limited to this configuration for other cases: 1) Motive Magnet (2)/s, 2) Fixed Magnet (3)/s with a hole, 3) Liner (4) (a tube, spacer, additional magnetic field, etc. in order to line and space the two magnets) and 4) Press (1) for the Motive Magnet (2) to move beyond the TP (the force of a lever, switch, pulley, someone's hand, electric solenoid, etc., whether or not mechanical action is added to the system) as shown in FIG. 1.

Figure 2:
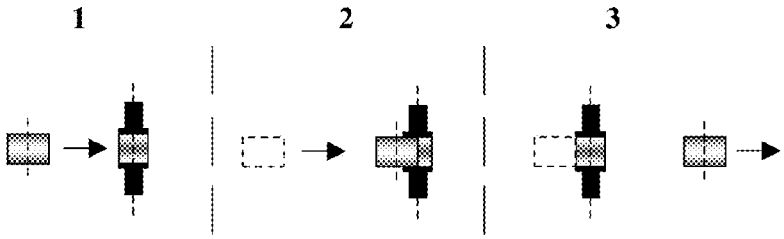
FIG. 2 shows the mechanism in three steps.

As shown in FIG. 2 in step 1) the Motive Magnet (2) tends automatically toward its locking position in the Liner (4) and Fixed Magnet (3), its pole flipping when the incorrect pole is brought near (provided it is permitted to flip), then 2) the Press (1) applies force on the Motive Magnet (2) to pass the Midline beyond the TP where 3) the Motive Magnet (2) accelerates out of the system in the same direction.

The Applicant proceeds from this simple description with mention of complications that arise in attempting to independently design a propulsion apparatus using the mechanism without consideration for the proper component spacing and strength of the magnetic fields, as subtle variations in design prevent the mechanism from occurring at all, which is claimed by the Applicant to add to the novelty of this invention as described.

While exact equations have not been fully defined for all varieties of the invention's successful operation (regarding magnetic field strengths, distances, magnet masses or similar), there are certain design conventions that are to followed for any propulsive usefulness to occur at all, as will be described—based on the preferred embodiment's measurements; when such geometric conventions are not considered, the magnets tend to behave as commonly recognized in other inventions by mere attraction or repulsion, but not propulsion.

For propelling a NeFeB disc Motive Magnet (2) (having the dimensions of ¾" D×½" L) from a NeFeB ring Fixed Magnet (3) (having the dimensions of 2" OD×1" ID×⅛" L), the geometric spacing conventions (labeled in FIG. 3) should be maintained wherein (1) is The Press (1), (2) is the Motive Magnet (2), (4) is the Fixed Magnet (3), (4) is The Liner (4) (made of a non-ferrous material), a=¾", a<c, b=1", b>c, d=½", d≤≥e (provided all other conventions are met) e=⅛", f~2 cm (offset distance w/respect to magnets' midlines for NeFeB Magnet Grades 30-45), f<(g+e/2), k>e, (i+d/2)>(g+e/2), j<c, $c<\sqrt{d^2+a^2}$,and h>i+d/2.

Figure 3:
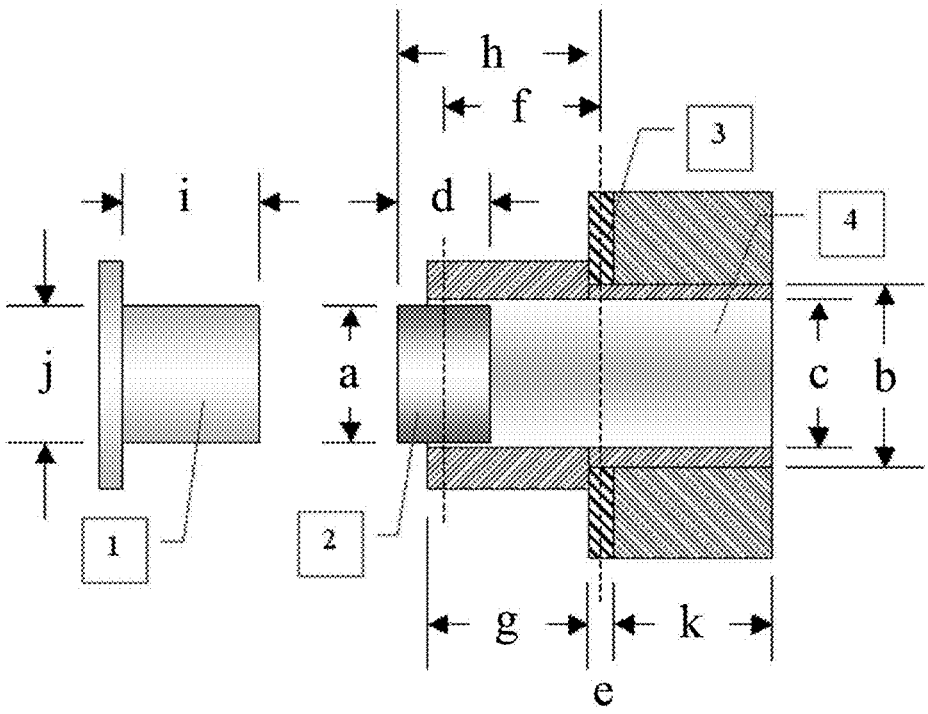
FIG. 3 shows required geometric conventions for magnet dimensions given.

An explanation for the required geometric conventions for FIG. 3 is then given, in order to better leave no description to assumption, as well as to fully describe the malfunctioning consequences for disregard of these conventions:

When a is greater than or equal to b, the Motive Magnet (2) will not slide in The Liner (4) and therefore is prevented from propelling.

When b is less than or greater than c, The Liner (4) will not fit in the hole of the Fixed Magnet (3), and without The Liner (4) in place, the Motive Magnet (2) will not evenly pass through the hole of the Fixed Magnet (3) and will not be propelled.

The length of d to e is not a factor in the propulsion, so long as the other design conventions can compensate for such differences.

When f (the magnetically-fixed distance between the Midline and the TP, the distance that needs to be reduced with The Press (1)) is greater than or equal to g plus e divided by two, the Motive Magnet (2) will not pass into the Liner (4); rather, will fall out and around, and tend toward an attraction to the off center face of the Fixed Magnet (3), preventing propulsion.

When k is less than e, the Motive Magnet (2) will pass through the Liner (4), but may become stuck on the opposite side of the Fixed Magnet (3) (preventing propulsion) in certain cases and field strengths; for this reason, k should be some length greater than e.

If g plus e divided by two is greater than or equal to i plus d divided by two. The Press (1) will not be long enough to bring the Midline beyond the TP, thereby preventing propulsion.

When j is greater than or equal to c, The Press (1) will not fit into The Liner (4), thereby preventing propulsion.

When c is greater than or equal to the square root of d squared plus a squared, the Motive Magnet (2) will flip over as it is pressed through The Liner (4), preventing propulsion; even approaching equality a small amount begins to reduce the usefulness of the propulsion.

Because two or more magnets do not behave as described above in and of their magnetic properties alone, or even with the addition of purely ferrous additional components, the Applicant claims that the minimum addition of two more components (the Liner (4) and the Press (1)) do make this mechanism novel and not obvious in view of any prior art.

The Applicant also claims that this mechanism is different from that of a rail gun or coil gun, as its kinetic energy propulsion is independent from any electrical input that may (or may not) be used as a Press (1); the former all require electrical circuitry to generate thrust, which typically cannot implement mechanical advantage, while this mechanism can implement mechanical advantage and does not require electricity input at all.

Applicant also claims that this mechanism is different from any type of solenoid action (even one implemented by means of permanent magnets), as solenoids, by definition, utilize a single axis of symmetry (that of the solenoid's pole), while this mechanism, as described below, utilizes axes (in a ring) of symmetry.

Additionally, two magnets both having holes may be used in this mechanism (i.e. a ring magnet in the hole of a larger ring magnet), as it is only the directional component within the ID of the larger magnet that allows for any change in momentum (a transition from the Motive Magnet (2)'s potential momentum to kinetic momentum, along with the Motive Magnet (2)'s potential energy to kinetic energy); a ring magnet as the Motive Magnet (2) may even travel farther distances than a disc magnet having the same OD, as it's mass is less, having the hole, resulting in less inertia.

The mechanism relies on the geometry of the hole within the ID of the Fixed Magnet (3) (in the case of the Fixed Magnet (3) having an ID larger than the OD of the Motive Magnet (2)) and the resulting additional directional component.

When considering two permanent magnets having the geometry of the hole, the Magnetic Curl (commonly symbolized as $\nabla$) and magnetic fields take on an additional directional component: one shared between the two magnets, but an additional direction for the Fixed Magnet (3) going the opposite way, which still results in just one additional direction when Motive Magnet (2) also has a hole.

In physics, curl is a vector having both a distance component and a directional component, where the curl is the sum of the two: $\nabla$=Re (r)+Im ($\theta$). "Re" denotes the real part (the distance, symbolized by r) and "Im" denotes the imaginary part (the angle, symbolized by theta).

In mathematics, a vector is a complex number (c), consisting of a real term (a) and an imaginary term (bi), but "real" and "imaginary" are only traditional terms used for reference, and are of no further description of abstraction or reality.

The field lines of a disc magnet are as "simple" or "complex" (compared to that of the ring magnet) as the disc magnet's shape is.

The B Field of a permanent disc magnet is considered a pseudovector in physics, and consists of a rotational component (as opposed to the Vector Magnetic A Field, which does not share this rotational component in a disc or ring magnet), which causes the B Field lines to curl around to the opposite pole of the magnet.

Figure 4:
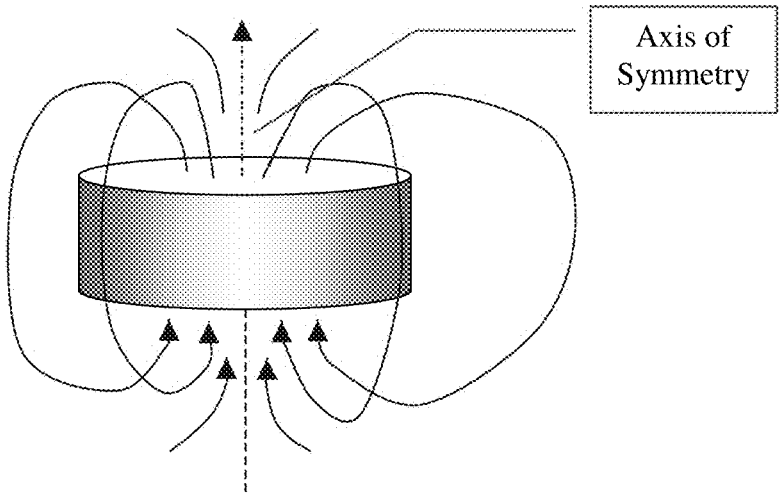
FIG. 4 shows B field lines of a permanent disc magnet.
Figure 5:
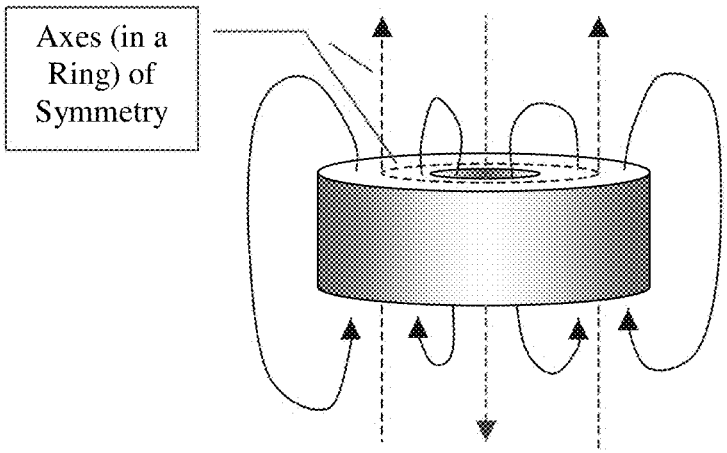
FIG. 5 shows a few B field lines in two dimensions (cross) of a permanent ring magnet, illustrating the additional directional component.

Upon magnetizing a material for use as a permanent magnet (NeFeB, AlNiCo, etc.), the permeability (typically symbolized as $\mu$) of the material's shape is relatively uniform throughout its physical dimensions, and so the B Field's lines arrange in a way that is also relatively uniform around its exterior, extending outward and around the shape from its center coordinate and then back through, as shown in FIG. 4.

However, with the presence of the hole (in a ring magnet for instance), the permeability of air (or space or gas, fluid or object having less permeability than the surrounding material) in the hole is less than that of the material. For this reason, along with Leonhard Euler's Principle of Least Action, it requires less action on the molecules of the magnetic domains in the material to limit any magnetization to the material itself (eliminating the hole from being magnetized).

Because of the elimination of the hole magnetization, the field lines have a shorter distance to transverse (and with less repulsion) by returning back through the hole for any point closer to the inner hole than the outside surrounding.

Figure 6:
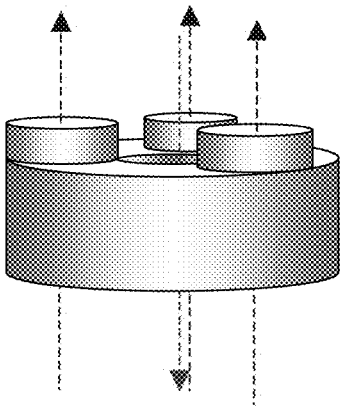
FIG. 6 shows interactive force between a ring magnet and three disc magnets.

This is easily observed and evidenced by where opposite poles between a permanent disc magnet and a permanent ring magnet attract, as shown in FIG. 6, which are to the centermost face of the ring material and not the hole.

Figure 7:
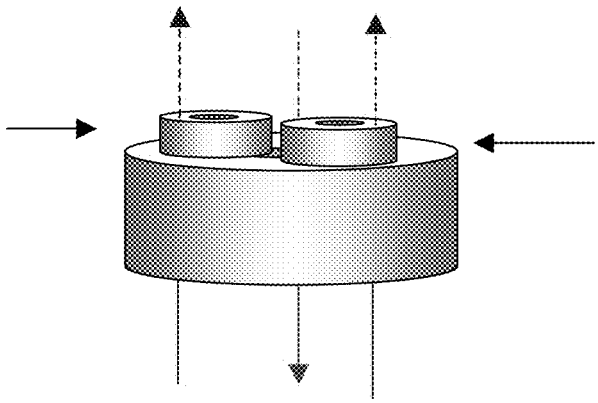
FIG. 7 shows interaction between a larger ring magnet and two smaller ring magnets; and, FIG. 8 shows an increase in potential energy with distance, converted to kinetic energy.

The interaction between two or more ring magnets, where one or more is/are smaller than the other, is somewhat different in terms of attraction than a ring magnet and a disc magnet, as the smaller ring magnets are pressed somewhat farther toward the hole than would a disc magnet, so that all poles align to the magnetic system's relaxed state (see FIG. 7).

However, the interaction between the larger and smaller ring magnets are identical at the hole to that between a ring magnet and a disc for identical respective OD's, as it is the outer pseudovector field lines (B Field lines in the case of FIG. 7) alone of the smaller magnet that interact with the directional component at the ID of the larger magnet and not the poles of the smaller disc magnet, nor the ID of a smaller ring magnet.

Because the B Field has a rotational component, the angle at which it curls at any given point around the magnet needs to be considered when describing an interaction at that point, as this is what gives rise to the propulsion of the magnet in this mechanism.

Having a Motive Magnet (2) and a Fixed Magnet (3) with the above geometries (a disc and a ring for instance, or a ring and a ring), along with the Liner (4) and Press (1), the invention allows for the smaller of two magnets to be propelled in a useful mechanical manner when the hole is in line with the magnet's polarization and when the larger magnet is fixed.

The Motive Magnet (2) locks in place from one end of the Fixed Magnet (3) (tends to a relaxed state) within the Liner (4) and Fixed Magnet (3) assembly because the poles of the Fixed magnet with the hole act stronger on the pole/s of the Motive Magnet (2) when the distance between the respective poles are greater than the distance between the Motive Magnet (2)' s poles and the center coordinate of larger Fixed Magnet (3) face's circumference.

The Motive Magnet (2) is attracted to this fully relaxed point from a distance, but opposing field lines upon entering the ID restrict the Motive Magnet (2)' s motion from easily passing through the hole (without the greater applied force of the Press (1)), which causes the relaxed state to be offset (hanging at some point greater than a zero distance; for the example in FIG. 3 this distance is roughly two cm).

When the Press (1) is able to force the Midline beyond the TP (where the force increases in repulsion up to that point), the Motive Magnet (2)'s field lines are turned beyond ninety degrees to that of the Fixed Magnet (3) and the two permanent magnets enter a state of greater repulsion than existed before breaching the TP, especially if it were to return back in the opposite direction even a nanometer (so long as it does not re-breach the TP), as the opposing force increases in that direction with the square of distance ($r^2$), which is why the Motive Magnet (2) accelerates out the opposite side of the Fixed Magnet (3) and Liner (4) at any point beyond the TP.

The acceleration of the Motive Magnet (2) is less action than flipping, and/or snapping together with the Fixed Magnet (3), would be when the liner is in place (which restricts such tendencies); however, this is only needed for a short distance until the Motive Magnet (2) is beyond the point where flipping is the lesser of the two paths/actions.

Figure 8:
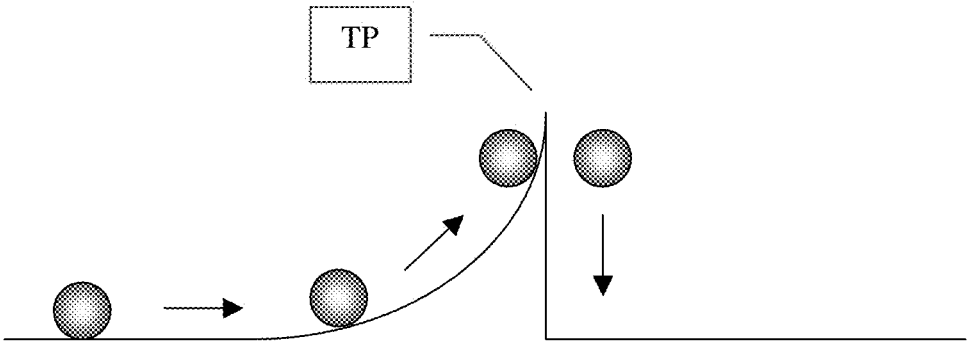

In the same as rolling (or sliding) an object up any incline greater than a linear slope, as shown in FIG. 8, so does the potential energy increase with distance as the Motive Magnet (2) is pressed toward the TP.

When pressed beyond the TP, the object experiences acceleration, where the potential energy is converted to kinetic energy.

However, the increase in potential energy of this mechanism comes from the magnetic fields themselves, as adding some mechanical advantage (a lever or pulley) to the Press (1) allows for the same amount of propulsive kinetic energy with less force (Law of a Lever).

In the same, adding greater mechanical advantage does not increase the kinetic energy of the propelled Motive Magnet (2) due to their independence (the same can be said for FIG. 8, where the gravitational field acting on the ball falling is independent of any mechanical advantage applied to the ball when climbing, even though their energies may be equal).

Because of the above facts, any apparatus that propels the Motive Magnet (2) using this mechanism cannot then be propelled through a second apparatus of equal field strength; it will simply lock into place of the second, requiring another action of another Press (1).

While an apparatus using this mechanism could propel the Motive Magnet (2) through a second apparatus having a lesser field strength, such propulsion in series would always diminish in energy and magnitude for each successive apparatus.

This mechanism can be used in the transfer of bank documents at drive-through bank teller stations, where physical document transfers can be made without electricity (for comparison of the propulsive distances that can be transversed, the setup and sizes shown in FIG. 3 propels the Motive Magnet (2) in a straight line across a rough level surface without wheels or bearings more than twenty feet; stronger and/or larger magnets can be designed to obtain greater distances).

Children's toys and hobby devices from small cars and/or trains to miniature (or large) roller coaster designs can easily implement this mechanism without electricity at high enough speeds to be of interest, but slow enough for safety concerns, depending on the requirements and design.

A single high voltage pulse discharge (like that in a flash bulb) to a solenoidal coil around the Motive Magnet (2) can act as the Press (1) to send a probe (projectile) from a spacecraft or satellite in any direction to enter any star or planet's atmosphere, comet, meteor or moon over vast distances and with far greater speeds than can be obtained when propelled from a nearby gravitational field (from earth), when considering the escape velocity of the cosmological object that would add to the Motive Magnet (2)'s acceleration.

The pull of a lever and/or spring Press (1) can propel the Motive Magnet (2) through a solenoid in an LRC circuit in order to induce electricity (adding to the novelty of a children's toy, lighting LEDs, triggering transistors or similar devices).

Nanotechnologies can implement greater microscopic motors and machines with this mechanism, as the effectiveness of magnetic properties increase the smaller the scale and the closer the distances for the same field strengths.

Two or more apparatuses implementing this mechanism can be used in lock, load and propel succession (with the aid of electrical timing devices) for factory or robotic needs.

The scope of these example practical applications are in no way to be considered the limit of possible applications, but rather are added to better illustrate this invention's claims.

What is claimed is:

1. A magnetic device for propulsion of a second magnet comprising:

a Fixed Magnet having a shaped hole with an inner cross section extending the width of said Fixed Magnet from the center of one pole face to the center of a second pole face parallel to the direction of said Fixed Magnet's polarity;

a Liner of non-ferrous material comprising a shell with an outer cross-section the same shape and smaller than the inner cross-section of said shaped hole cut through said Fixed Magnet and said Liner having an inner cross-section the same shape and smaller than the outer cross-section of said Liner;

said Liner fitted within said Fixed Magnet's shaped hole and having an entry section extending beyond said one pole face of said Fixed Magnet;

a Motive Magnet having an outer cross-section the same shape and smaller than the inner cross-section of said liner and a width defined by said Motive Magnet's one pole face and second pole face; and, a Press capable of pushing said Motive Magnet into said entry section of said Liner and beyond where a mid point in said Motive Magnet's width passes a threshold point in said Fixed Magnet's width wherein said Motive Magnet's magnetic field lines are at ninety degrees to that of said Fixed Magnet's field lines and said Motive Magnet and said Fixed Magnet enter a state of greater repulsion than existed before breaching said threshold point resulting in propulsion of said Motive Magnet out of said shaped hole in said Fixed Magnet's second pole face and away from said Fixed Magnet's second pole face.

* * * * *